US011467531B2

(12) United States Patent
Yamaguchi

(10) Patent No.: US 11,467,531 B2
(45) Date of Patent: Oct. 11, 2022

(54) IMAGE FORMING APPARATUS INCLUDING DEVELOPING UNIT AND PHOTOSENSITIVE UNIT

(71) Applicant: SHARP KABUSHIKI KAISHA, Sakai (JP)

(72) Inventor: Jun Yamaguchi, Sakai (JP)

(73) Assignee: SHARP KABUSHIKI KAISHA, Sakai (JP)

( * ) Notice: Subject to any disclaimer, the term of this patent is extended or adjusted under 35 U.S.C. 154(b) by 0 days.

(21) Appl. No.: 17/489,094

(22) Filed: Sep. 29, 2021

(65) Prior Publication Data

US 2022/0107602 A1 Apr. 7, 2022

(30) Foreign Application Priority Data

Oct. 1, 2020 (JP) ..... JP2020-167068

(51) Int. Cl.
*G03G 21/16* (2006.01)
*G03G 21/18* (2006.01)

(52) U.S. Cl.
CPC ..... *G03G 21/1647* (2013.01); *G03G 21/1821* (2013.01); *G03G 21/1619* (2013.01); *G03G 2221/163* (2013.01); *G03G 2221/1603* (2013.01); *G03G 2221/1606* (2013.01)

(58) Field of Classification Search
CPC ..... G03G 21/1619; G03G 21/1647; G03G 21/1821; G03G 2221/1603; G03G 2221/1606; G03G 2221/163; G03G 2221/1651; G03G 2221/1654; G03G 21/1825
See application file for complete search history.

(56) References Cited

U.S. PATENT DOCUMENTS

2012/0321342 A1* 12/2012 Mori ..... G03G 21/1825 399/111
2017/0108828 A1 4/2017 Asanuma et al.
2019/0391527 A1* 12/2019 Yamaguchi ..... G03G 21/1821

FOREIGN PATENT DOCUMENTS

JP 2017-076037 A 4/2017

* cited by examiner

*Primary Examiner* — Sophia S Chen
(74) *Attorney, Agent, or Firm* — ScienBiziP, P.C.

(57) ABSTRACT

A developing unit and a photosensitive unit respectively have engaging mechanism parts that fit in each other in the longitudinal direction so as to integrate the developing unit and the photosensitive unit. The developing unit includes, as the engaging mechanism part, a first holding member to hold the front end part of a drum shaft. The photosensitive unit includes, as the engaging mechanism part, a second holding member to hold the rear end part of a roller shaft. The first holding member and the second holding member are provided in a slidable manner in a direction in which the developing roller and the photosensitive drum separate from each other, and furthermore are biased toward a direction in which the developing roller and the photosensitive drum come close to each other.

6 Claims, 12 Drawing Sheets

IMAGE FORMING APPARATUS INCLUDING DEVELOPING UNIT AND PHOTOSENSITIVE UNIT

CROSS-REFERENCE TO RELATED APPLICATIONS

This application claims priority under 35 U.S.C. § 119 (a) on Patent Application No. 2020-167068 filed in Japan on Oct. 1, 2020, the entire contents of which are herein incorporated by reference.

DESCRIPTION OF THE BACKGROUND ART

Some kinds of image forming apparatuses have a configuration in which a photosensitive unit including a photosensitive drum (i.e. an electrostatic latent image carrier) and a developing unit including a developing roller (i.e. a developer carrier) can be respectively inserted into and extracted from an apparatus main body. In these image forming apparatuses, it is preferable to reduce the distance between the outer peripheral surface of the photosensitive drum and the outer peripheral surface of the developing roller (hereinafter also referred to as the "DSD": drum sleeve distance) in order to respond to a request for good image quality, and thus, it is needed to support the rotating shaft of the photosensitive drum and the rotating shaft of the developing roller such that the distance of the axes of the shafts is structurally constant. However, since the photosensitive drum and the developing roller both are the components to rotate, rotational runout is likely to occur. Thus, it is difficult to support the rotating shafts so as to maintain the DSD with high accuracy.

For example, Japanese Unexamined Patent Application Publication 2017-076037 discloses an image forming apparatus including: a photosensitive unit rotatably holding a photosensitive drum; a developing unit including a developing roller; gap maintaining members provided on the photosensitive drum or the developing roller; a biasing member provided between the photosensitive unit and the developing unit; and an electric contact portion coming into contact with an electric contact to input and output electricity. The developing unit is biased toward the photosensitive unit, and thus it is possible to maintain the distance of the shaft axes of the developing roller and the photosensitive drum with the gap maintaining members coming into contact with the photosensitive drum.

In the above-described conventional image forming apparatus, the biasing member is provided between the photosensitive unit and the developing unit, and the photosensitive unit and the developing unit are integrated with each other by attaching, individually, a plurality of components such as a development side member, bearing members, a drum bearing and coupling pins. For this reason, when separating the photosensitive unit and the developing unit at the time of maintenance and the like, it is necessary to remove the above-described plurality of components and biasing members one by one, which results in a very complicated maintenance work. Furthermore, it will also be a time-consuming work to reassemble them.

Thus, a heavy workload may be required to use an integrated photosensitive unit and the developing unit, which leads to bad maintainability and furthermore to change of the DSD depending on product accuracy and/or assembling accuracy.

SUMMARY OF THE INVENTION

The present invention was made in consideration of the above circumstances, an object of which is to provide an image forming apparatus that maintains the distance between the outer peripheral surface of the photosensitive drum and the outer peripheral surface of the developing roller with high accuracy and that is capable of integrating or separating the developing unit and the photosensitive unit with a simple work.

In order to achieve the above object, the present invention provides an image forming apparatus including a developing unit having a developing roller, and a photosensitive unit having a photosensitive drum, in which the developing unit and the photosensitive unit are separably integrated with each other so as to be installed in and removed from an apparatus main body in an integrated state. The developing unit and the photosensitive unit are disposed in a state capable of relative movement in an axial direction of a drum shaft of the photosensitive drum, and respectively have engaging mechanism parts that fit in each other in the axial direction according to the relative movement so as to integrate the developing unit and the photosensitive unit. The developing unit includes, as the engaging mechanism part: a first supporting part extending toward the photosensitive unit; and a first holding member provided on the first supporting part so as to hold one end part of the drum shaft. The photosensitive unit includes, as the engaging mechanism part: a second supporting part extending toward the developing unit; and a second holding member provided on the second supporting part so as to hold one end part of a roller shaft, which is on a side opposite to the one end part of the drum shaft, of the developing roller. The first holding member and the second holding member are provided both in a slidable manner in a direction in which the developing roller and the photosensitive drum separate from each other. The first holding member and the second holding member each have a biasing member so that the first holding member and the second holding member are respectively biased toward a direction in which the developing roller and the photosensitive drum come close to each other.

In the image forming apparatus having the above-described configuration, it is preferable that the first holding member and the second holding member are disposed on a virtual straight line connecting a rotation center of the developing roller and a rotation center of the photosensitive drum so that the first holding member and the second holding member are slidable on the virtual straight line.

Also, it is preferable that at least either one of the drum shaft and the roller shaft has a tapered part at a tip part thereof.

Furthermore, it is preferable that the first holding member includes a first fitting hole in which the drum shaft is fitted while the second holding member includes a second fitting hole in which the roller shaft is fitted, and that at least either one of the first fitting hole and the second fitting hole has a tapered part on an inner surface thereof.

With the above-described configuration, it is possible that the developing unit and the photosensitive unit are integrated with/separated from each other with a simple work. Furthermore, the second holding member to hold the roller shaft of the developing roller and the first holding member to hold the drum shaft of the photosensitive drum are both provided in a slidable manner in the direction in which the developing roller and the photosensitive drum separate from each other. Also, the first holding member and the second holding member each have the biasing member so that the first holding member and the second holding member are respectively biased toward the direction in which the developing roller and the photosensitive drum come close to each other. Therefore, the developing unit can be integrated with the photosensitive unit without coming into contact with the photosensitive drum. Thus, it is possible to stably maintain the distance between the outer peripheral surface of the photosensitive drum and the outer peripheral surface of the developing roller with high accuracy.

Since the present invention includes the engaging mechanism parts that integrate the developing unit and the photosensitive unit, it is possible that the developing unit and the photosensitive unit are integrated with/separated from each other with a simple work.

DESCRIPTION OF THE PREFERRED EMBODIMENTS

Hereinafter, an image forming apparatus according to an embodiment of the present invention will be described with reference to the drawings.

(General Configuration of Image Forming Apparatus)

Figure 1:
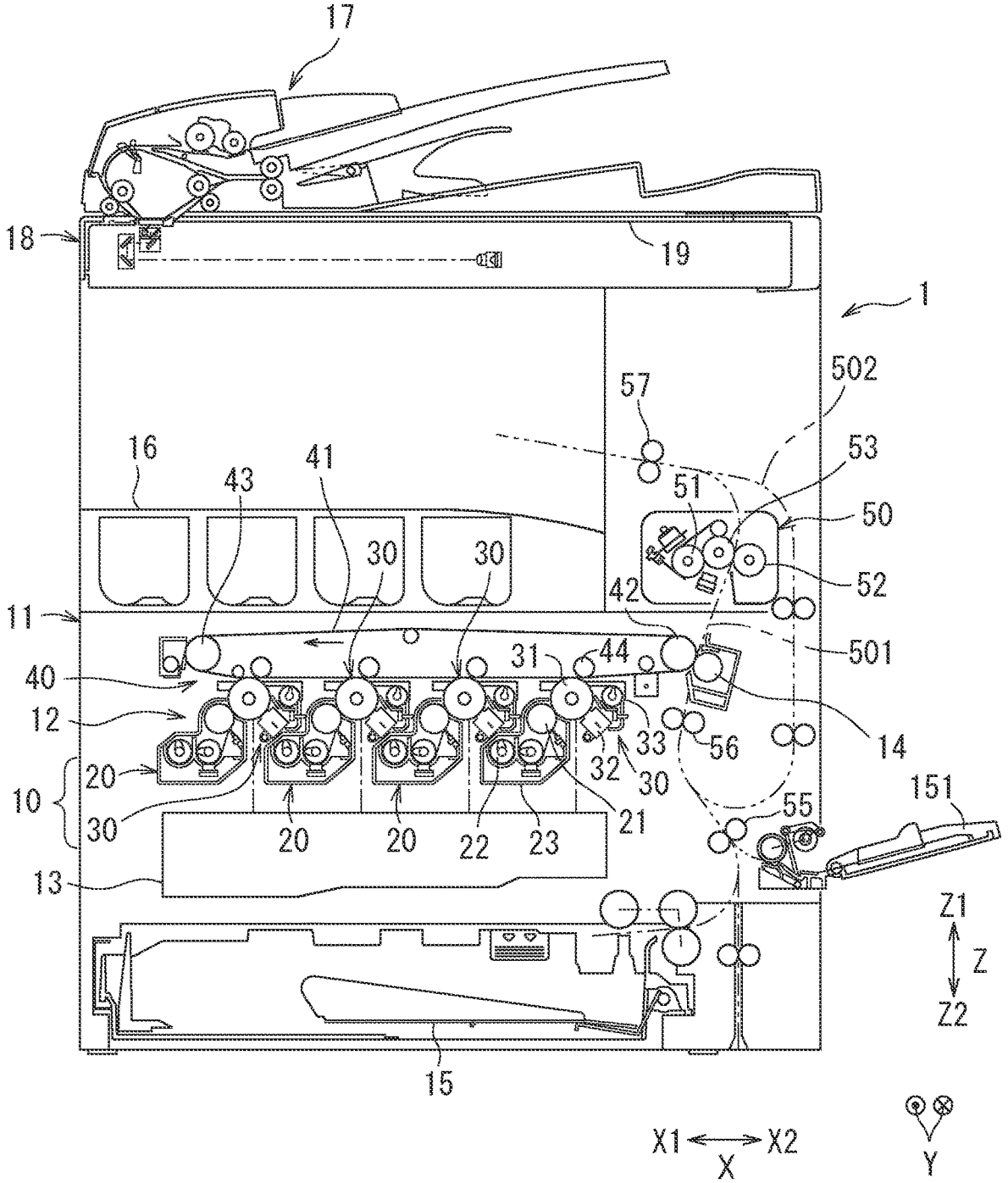
FIG. 1 is a cross-sectional view illustrating a schematic configuration of an image forming apparatus according to an embodiment of the present invention.

FIG. 1 is a cross-sectional view illustrating a schematic configuration of an image forming apparatus 1 according to the embodiment of the present invention.

The image forming apparatus 1 is a multifunction peripheral (MFP) functioning as a copier, a printer, a scanner, a facsimile machine and the like. The image forming apparatus 1 sends an image of an original sheet read by an image reading unit 18 to an external device, and forms a multicolor or monochrome image of the read original or an image received from an external device on a sheet.

For the sake of explanation, a direction along a rotating shaft of a photosensitive drum 31 in the drawings is defined as the longitudinal direction (axial direction) Y, and the front side is defined as Y1 and the back side is defined as Y2, as shown in FIG. 1 (hereinafter referred to as the "front side Y1" and the "back side Y2" also in the other drawings). Also as shown in FIG. 1, when the image forming apparatus 1 is viewed from the front side, the left side is defined as X1 and the right side is defined as X2 in the horizontal direction X intersecting with the axial direction (hereinafter referred to as the "left side X1" and the "right side X2" also in the other drawings). Also, in the vertical direction Z intersecting with the horizontal direction X, the upper side is defined as Z1 and the lower side is defined as Z2 (hereinafter referred to as the "upper side Z1" and the "lower side Z2" also in the other drawings). However, these definitions do not at all limit the use direction of the image forming apparatus 1.

The image forming apparatus 1 includes an apparatus main body 11 being equipped with an image forming device 12 and the like, and the image reading unit 18 provided above the apparatus main body 11. On the image reading unit 18, an original sheet transport unit (automatic document feeder, "ADF") 17 is provided and supported so as to be freely opened and closed. The original sheet transport unit 17 can be opened to expose a platen glass 19 of the image reading unit 18 so that an original sheet can be manually placed thereon. Also, the original sheet transport unit 17 automatically transports an original sheet that is placed thereon. The image reading unit 18 reads the manually placed original sheet or the original sheet transported by the original sheet transport unit 17, and generates image data.

The apparatus main body 11 includes: a control device including a CPU and a memory (not shown); and the image forming device 12. The image forming device 12 includes: a light exposure unit 13; a developing unit 20; a photosensitive unit 30; an intermediate transfer belt unit 40; a transfer roller 14; and a fixing unit 50. The image forming device 12 forms an image on a sheet transported from a sheet feeding tray 15 or a manual sheet feeding tray 151, and discharges the sheet on which the image has been formed to a discharge tray 16. As to image data to form an image on a sheet, image data read by the image reading unit 18 or image data transmitted from an external computer are used.

The two units, i.e. the developing unit 20 and the photosensitive unit 30, are integrated in a state of being separable from each other so as to constitute a process cartridge 10. The process cartridge 10 is capable of being inserted into and extracted from the apparatus main body 11 through the front side thereof in a state in which the developing unit 20 and the photosensitive unit 30 are integrated with each other.

The image data processed by the image forming apparatus 1 corresponds to a color image in four colors, i.e. black (K), cyan (C), magenta (M), and yellow (Y). Thus, four process cartridges 10 are installed in the apparatus main body 11 so as to form four kinds of latent images in the respective colors, and accordingly, four image stations are provided.

The four process cartridges 10 are arranged in a row in the horizontal direction along the travel direction of the surface of an intermediate transfer belt 41.

The light exposure unit 13 is a laser scanning unit (LSU) including a laser emitting part and a reflecting mirror. The light exposure unit 13 exposes the electrically charged surface of the photosensitive drum 31 so as to form an electrostatic latent image corresponding to the image data on the surface of the photosensitive drum 31.

The photosensitive unit 30 includes: the photosensitive drum 31; a charger 32; and a cleaner unit 33. The photosensitive drum 31 is an electrostatic latent image carrier constituted of a cylindrical base body having conductivity and a photosensitive layer formed on the base body. The photosensitive drum 31 is rotatable about a shaft by a drive part (not shown). The charger 32 charges the surface of the photosensitive drum 31 to a predetermined potential. The cleaner unit 33 includes a cleaning blade. The cleaner unit 33 removes and collect toner remaining on the surface of the photosensitive drum 31 after transferring a toner image on the intermediate transfer belt 41.

The developing unit 20 makes the electrostatic latent image formed on the surface of the photosensitive drum 31 visible (i.e. forms the toner image) with the corresponding toner of the four colors (Y, M, C, and K). The developing unit 20 includes: a developing roller 21 that supplies toner to the photosensitive drum 31; and transport members 22. The developing roller 21 is disposed adjacent to and along the photosensitive drum 31, and is rotatable about a shaft by a drive part (not shown). A developer housing 23 of the developing unit 20 houses developer containing toner, carrier and the like. The toner is supplied to the photosensitive drum 31 via the developing roller 21.

The intermediate transfer belt unit 40 includes: the intermediate transfer belt 41; a drive roller 42; a driven roller 43 and intermediate transfer rollers 44. The intermediate transfer belt unit 40 is provided above the photosensitive drums 31. The intermediate transfer belt 41 is disposed in a manner of coining into contact with each of the photosensitive drums 31. Toner images in the respective colors formed on the respective photosensitive drums 31 are sequentially transferred to the intermediate transfer belt 41 using the intermediate transfer rollers 44 such that the toner images are superimposed one after another, thus a multicolor toner image is formed on the surface of the intermediate transfer belt 41. The transfer roller 14 is disposed in the vicinity of the drive roller 42. The toner image formed on the intermediate transfer belt 41 is transferred to the sheet when a sheet passes through a nip region between the intermediate transfer belt 41 and the transfer roller 14 as a secondary transfer unit.

The fixing unit 50 includes a heating roller 51, a pressure roller 52 and a fixing roller 53, and is provided above the transfer roller 14. The fixing roller 53 is set at a predetermined fixing temperature by the heating roller 51. When the sheet passes through the nip region between the fixing roller 53 and the pressure roller 52, the toner image transferred onto the sheet is melted, mixed and pressed, thereby the toner image is thermo-fixed onto the sheet.

A first sheet transport path 501 is provided in the apparatus main body 11 so as to transport the sheet from the sheet feeding tray 15 or the manual sheet feeding tray 151 to the discharge tray 16 via a registration rollers 56, the transfer roller 14 and the fixing unit 50. Also, a second sheet transport path 502 for the duplex printing on the sheet is provided so as to return the sheet that have passed through the fixing unit 50 after being subjected to the simplex printing to the first sheet transport path 501 on the upstream side of the transfer roller 14 in the sheet transfer direction. A plurality of transport rollers 55 and 57 is provided on the first sheet transport path 501 and the second sheet transport path 502 so as to appropriately give the sheet an auxiliary traveling force.

(Process Cartridge)

The process cartridge 10 provided in the image forming apparatus 1 is constituted of the developing unit 20 and the photosensitive unit 30 that are integrated in a state of being separable from each other. The developing unit 20 and the photosensitive unit 30 are positioned and integrated so as to be inserted into and extracted from a predetermined position of the apparatus main body 11. Since the developing unit 20 and the photosensitive unit 30 are integrated in advance to be installed, it is possible to reduce the size of the apparatus main body 11.

In a conventional image forming apparatus in which the developing unit and the photosensitive unit are individually installed in the apparatus main body, the developing unit should be inserted or extracted with a guide space being ensured between the developing unit and the photosensitive drum in order to prevent the photosensitive drum from being damaged, which results in a size-increased apparatus main body. On the other hand, in the image forming apparatus 1 according to this embodiment, these units are integrated so as to be installed. Thus, the guide space is not needed, which leads to size reduction.

It is preferable that the process cartridge 10 is divided into the developing unit 20 and the photosensitive unit 30 with a simple operation and also that they are integrated with a simple operation, taking into account maintainability. Thus, in the image forming apparatus 1 according to this embodiment, the developing unit 20 and the photosensitive unit 30 that constitute the process cartridge 10 are each provided with an engaging mechanism part as described below so that they are integrated with and separated from each other with a simple operation.

(Developing Unit)

Figure 2:
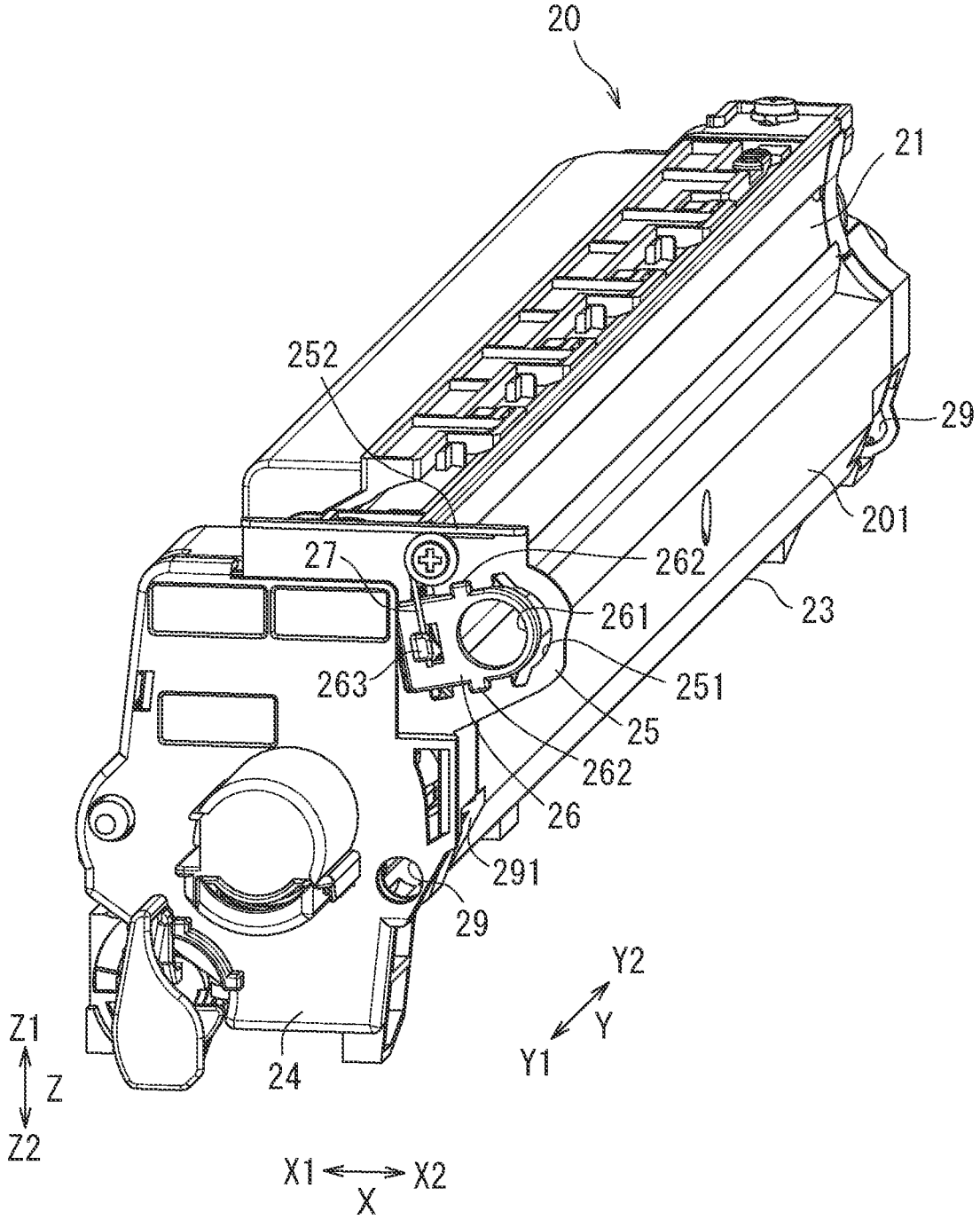
FIG. 2 is a perspective view of a developing unit included in the image forming apparatus, viewed from the front side.
Figure 3:
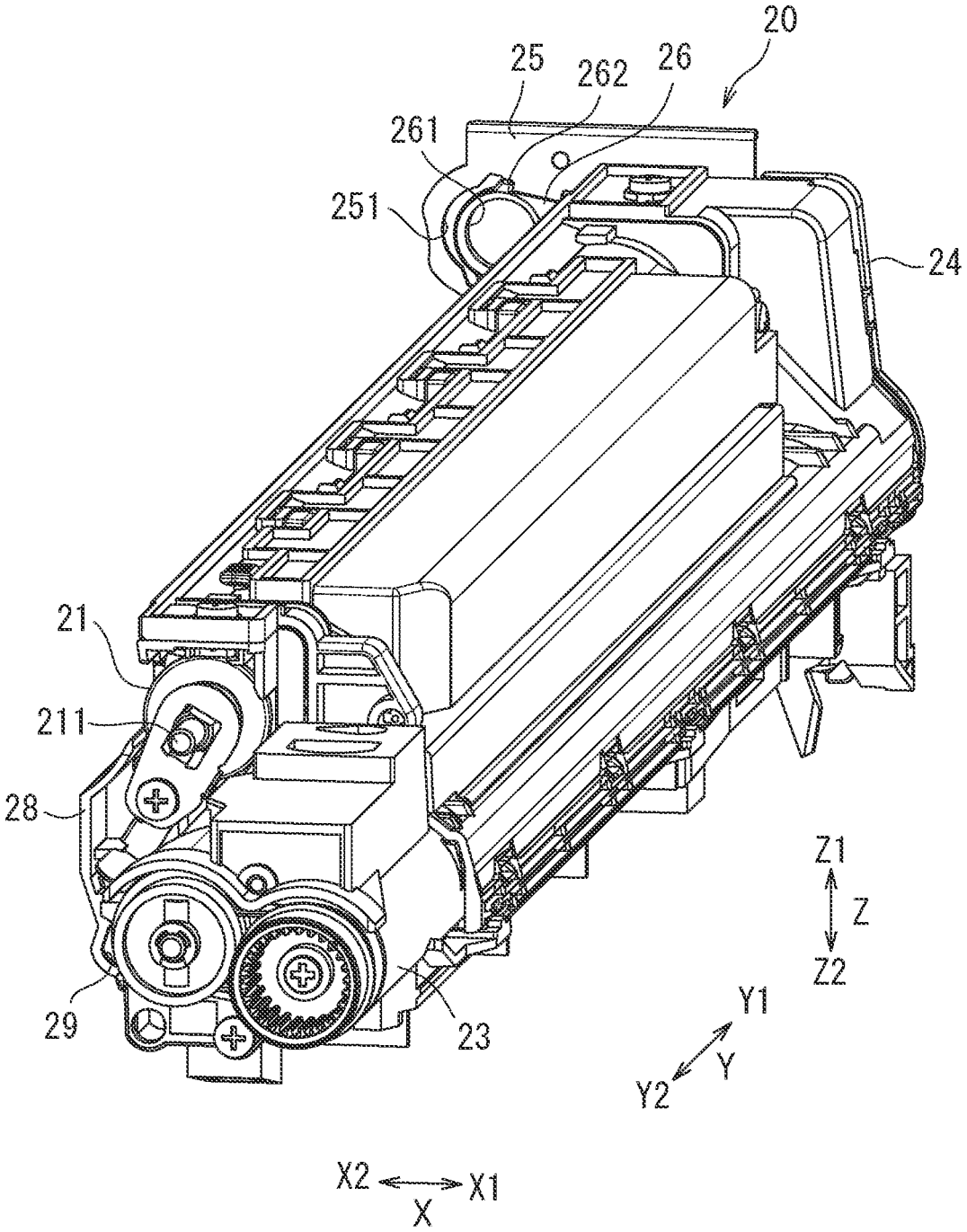
FIG. 3 is a perspective view of the developing unit viewed from the back side.
Figure 4:
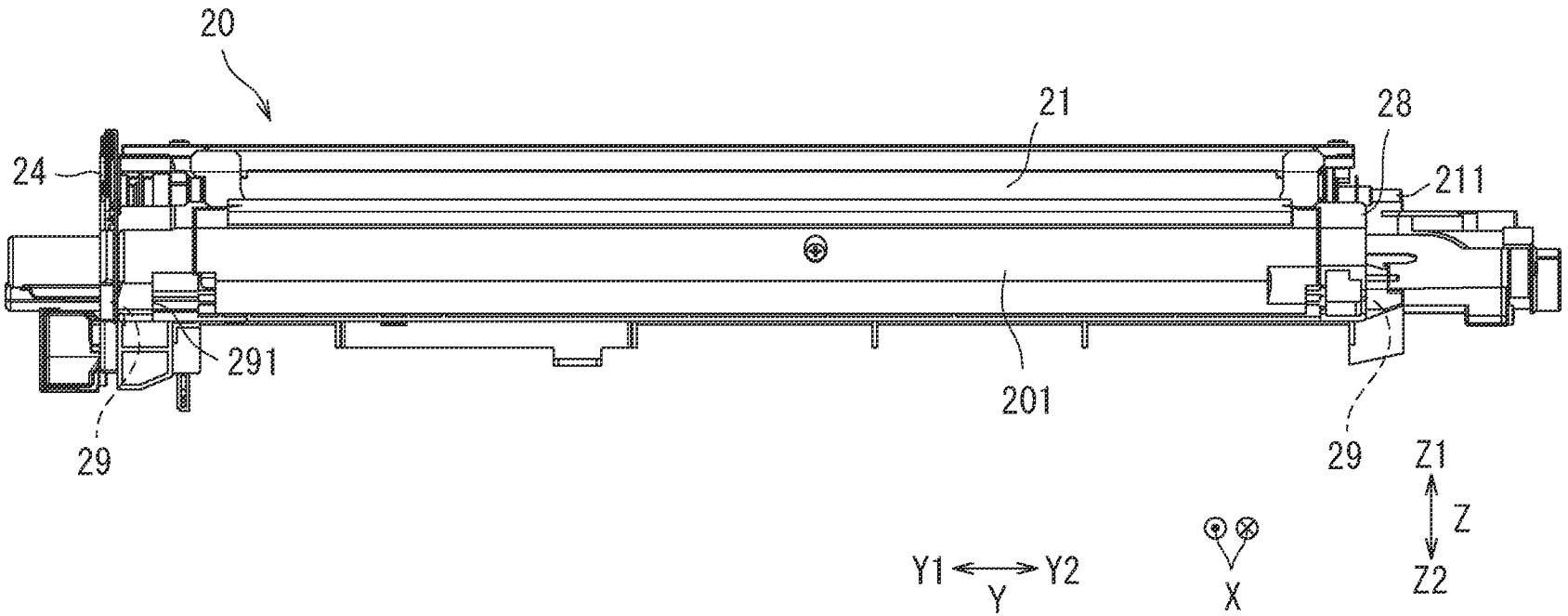
FIG. 4 is a side view of the developing unit.

FIGS. 2 to 4 indicate the developing unit 20. FIG. 2 is a perspective view of the developing unit 20 viewed from the front side Y1. FIG. 3 is a perspective view of the developing unit 20 viewed from the back side Y2. FIG. 4 is a side view (right-side view) of the developing unit 20.

As shown in FIG. 1, the developing unit 20 that includes the developing roller 21 and the transport members 22 is integrally held in the developer housing 23 in accordance with a predetermined positional arrangement. In the developer housing 23, two transport members are disposed such that their rotating shafts are parallel to each other, and furthermore the developer containing a mixture of toner, carrier and the like is housed. The transport member 22 is, for example, an auger screw in which a spiral blade is formed on the outer peripheral surface of the cylindrical rotating shaft, (screw shaft).

The developing roller 21 is disposed above the transport members 22 in the developer housing 23. As shown in FIGS. 2 and 3, the developing roller 21 is disposed so as to be partly exposed from the developer housing 23. The developing roller 21 is a magnet roller that functions as a developer carrier, and is provided parallel to the photosensitive drum 31. In FIG. 2, a part of the developing roller 21 is exposed from the side surface of the developer housing 23 on the right side X2. With respect to this developing roller 21, the photosensitive drum 31 is disposed such that their respective outer peripheral surfaces are close to each other.

The developing unit 20 includes a front frame 24 and a rear frame 28 so as to rotatably support both end parts of a roller shaft 211 of the developing roller 21 via bearings. As shown in FIG. 3, a rear end part of the roller shaft 211 protrudes further from the rear frame 28 in the back side Y2 direction. On the upper part of the front frame 24, a first supporting part 25 is provided so as to extend toward the photosensitive unit 30 (in FIG. 2, the right side X2).

A first holding member 26 is provided on the first supporting part 25, in which a front end part of a drum shaft 311 of the photosensitive drum 31 is fitted. The rear end part of the roller shaft 211 of the developing roller 21 and the first holding member 26 constitute engaging mechanism parts together with a second holding member 37 and the front end part of the drum shaft 311 described later. The engaging mechanism parts position the photosensitive unit 30 relative to the developing unit 20 so as to integrate them with each other.

(Photosensitive Unit)

Figure 5:
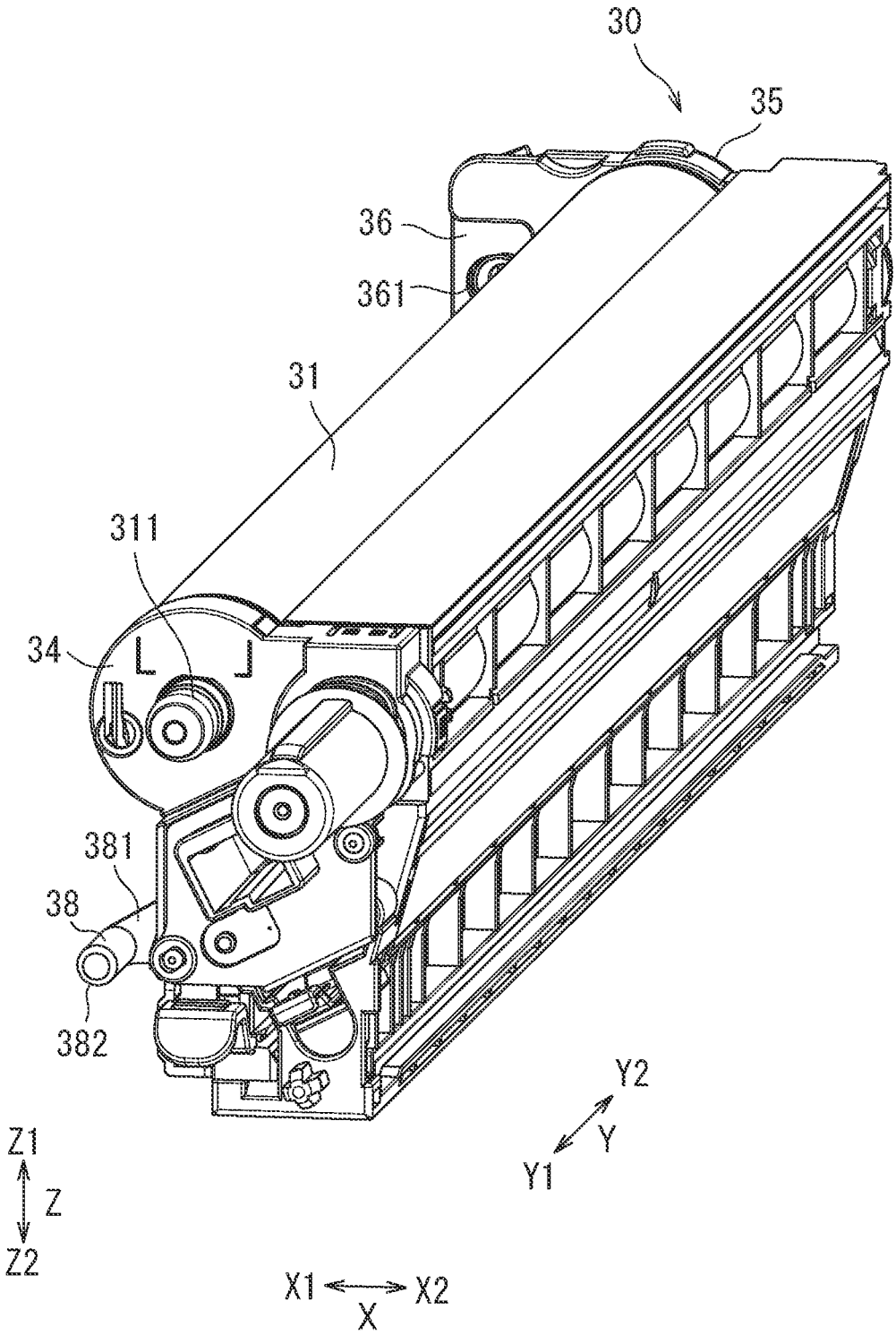
FIG. 5 is a perspective view of a photosensitive unit included in the image forming apparatus, viewed from the front side.
Figure 6:
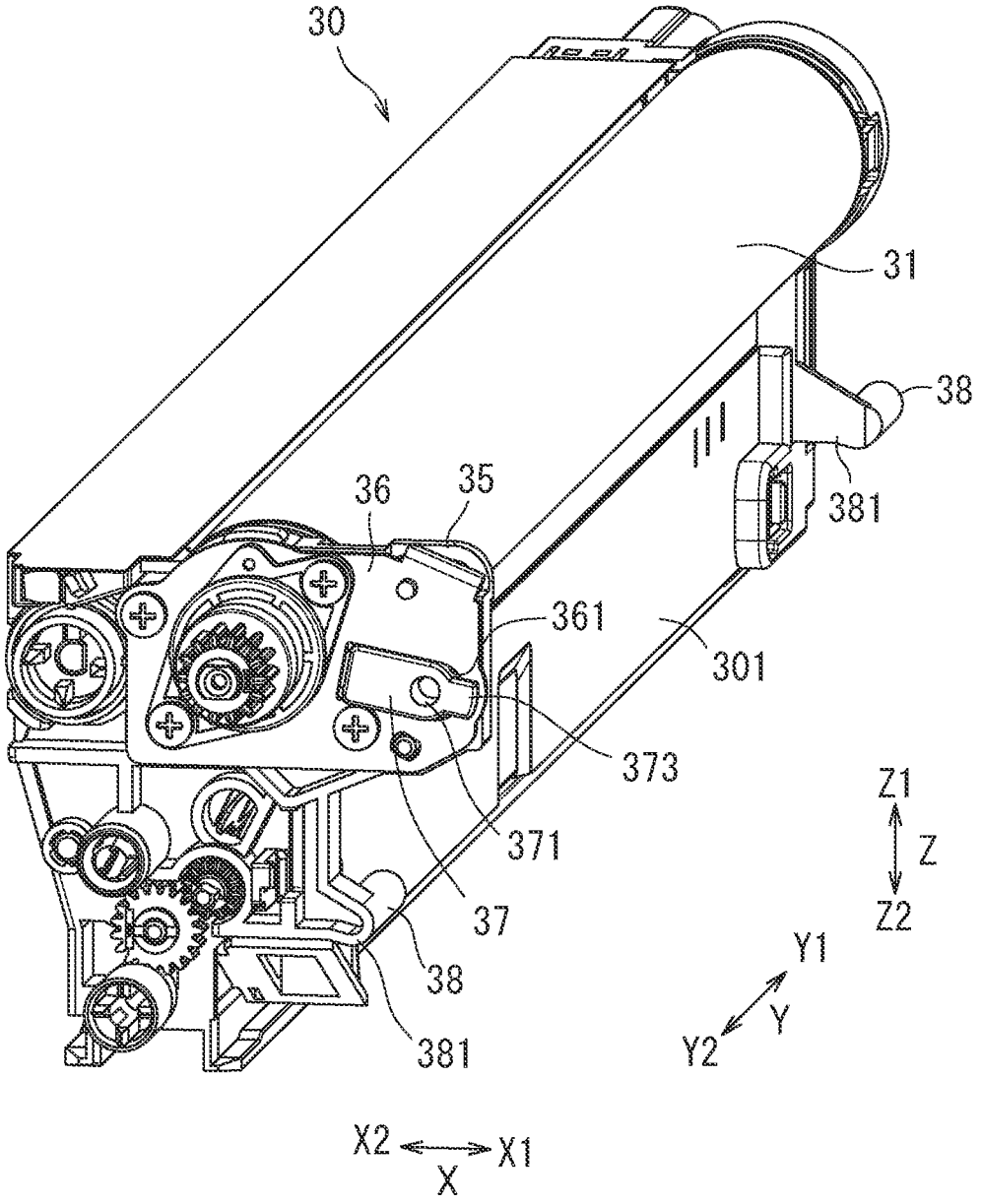
FIG. 6 is a perspective view of the photosensitive unit viewed from the back side.
Figure 7:
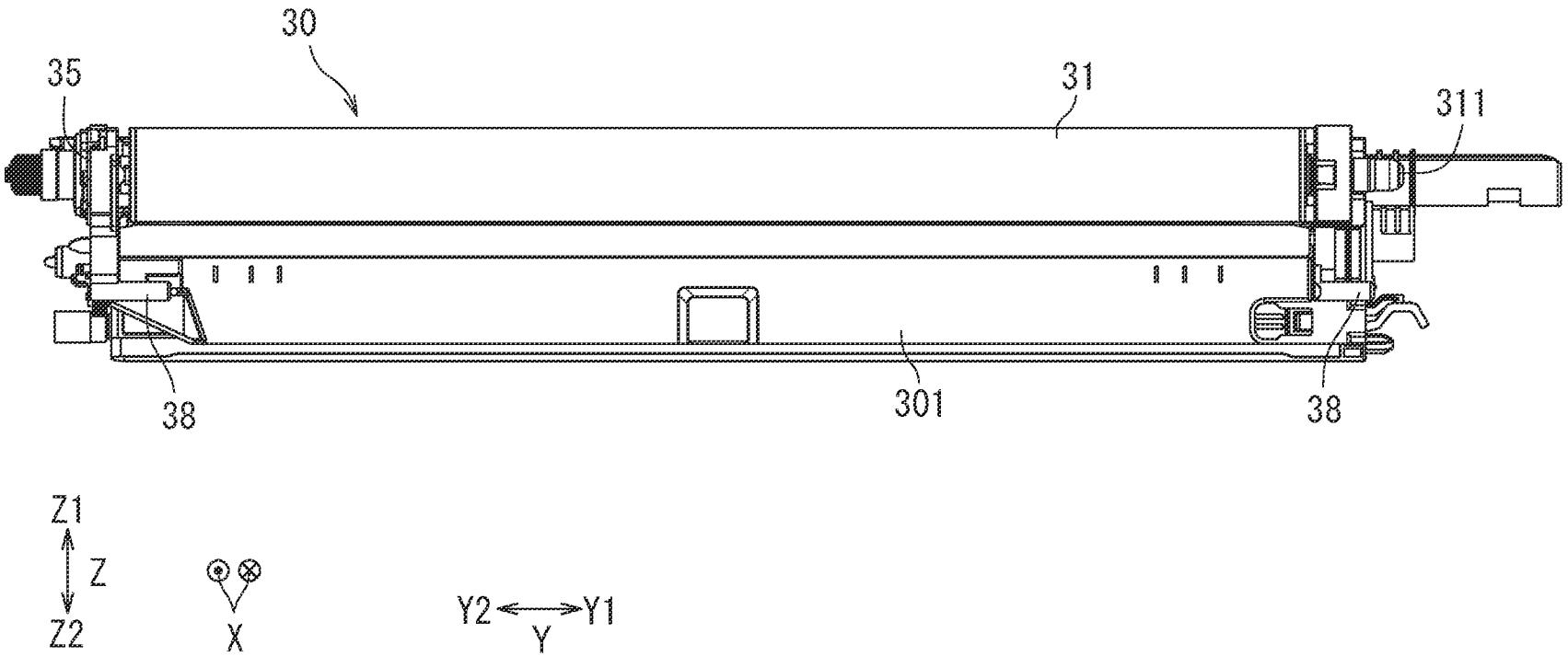
FIG. 7 is a side view of the photosensitive unit.

FIGS. 5 to 7 indicate the photosensitive unit 30. FIG. 5 is a perspective view of the photosensitive unit 30 viewed from the front side Y1. FIG. 6 is a perspective view of the photosensitive unit 30 viewed from the back side Y2. FIG. 7 is a side view (left-side view) of the photosensitive unit 30.

As shown in FIG. 1, the photosensitive unit 30 that includes the photosensitive drum 31, the charger 32 and the cleaner unit 33 is integrally held in accordance with a predetermined positional arrangement. As shown in FIG. 5, the developing unit 20 is to be disposed on the left side X1 with respect to the photosensitive unit 30. The photosensitive drum 31 is disposed on the side of the developing unit 20. Also, the photosensitive drum 31 is provided in the photosensitive unit 30 such that the left upper half part of the photosensitive drum 31 is exposed when viewed from the front side Y1.

The drum shaft 311 of the photosensitive drum 31 is provided along the longitudinal direction Y, and is rotatably supported by bearings provided on a front frame 34 and a rear frame 35. The front end part of the drum shaft 311 protrudes further from the front frame 34 in the front side Y1 direction. As shown in FIG. 6, on the upper part of the rear frame 35, a second supporting part 36 is provided so as to extend toward the developing unit 20 (in FIG. 6, the left side X1). The second holding member 37 is provided on the second supporting part 36, in which a rear end part of the roller shaft 211 of the developing roller 21 is fitted.

(Engaging Mechanism Part)

The developing unit 20 and the photosensitive unit 30 are disposed in a relatively movable manner in the axial direction of the drum shaft 311 of the photosensitive drum 31 (in this case, in the longitudinal direction Y). Also, the developing unit 20 and the photosensitive unit 30 respectively have engaging mechanism parts that fit in each other in the axial direction according to the relative movement to integrate the developing unit 20 and the photosensitive unit 30.

As the engaging mechanism part, the developing unit 20 includes the first supporting part 25 extending toward the photosensitive unit 30 and the first holding member 26 that holds the front end part of the drum shaft 311 of the photosensitive drum 31, as shown in FIG. 2. Also, the photosensitive unit 30 includes, as the engaging mechanism part, the second supporting part 36 extending toward the developing unit 20 and the second holding member 37 that holds the rear end part of the roller shaft 211 of the developing roller 21, as shown in FIG. 6. The front end part of the drum shaft 311 is fitted in the first holding member 26 in the longitudinal direction Y while the rear end part of the roller shaft 211 is fitted in the second holding member 37 in the longitudinal direction Y.

As shown in FIG. 5, the photosensitive unit 30 has guide pins 38 that are provided on an inner side surface (a surface on the left side in FIG. 5) 301 facing the developing unit 20. As shown in FIGS. 6 and 7, the respective guide pins 38 are provided on the front side Y1 and the back side Y2 of the inner side surface 301 of the photosensitive unit 30. In this example, each guide pin 38 extends in the front side Y1 direction from a base part 381 that is provided to extend from the inner side surface 301 toward the developing unit 20 (i.e. in the left side X1 direction of the horizontal direction X). The guide pin 38 has a substantially cylindrical shape that extends in the longitudinal direction Y, and is provided with a tapered part 382 at the tip part thereof.

The developing unit 20 has guide parts 29 respectively formed in the front frame 24 and the rear frame 28. The guide pins 38 are respectively inserted into the guide parts 29. As shown in FIG. 2, each guide part 29 is formed as a hole penetrating in the longitudinal direction Y, and has a size corresponding to the guide pin 38. On an inner side surface 201 behind (in the back side Y2 direction of) the hole of the guide part 29 on the front side Y1, a guide recess 291 is provided to guide the guide pin 38 to the guide part 29. The guide pin 38 is slid in the front side Y1 direction while coming into contact with the guide recess 291. Thus, the guide pin 38 is inserted into the guide part 29, which guides the photosensitive unit 30 to the position to be integrated with the developing unit 20.

In this way, into each of the guide parts 29 provided one by one on the front and rear sides of the developing unit 20, the corresponding one of the respective guide pins 38 provided on the front and rear sides of the photosensitive unit 30 is inserted. Thus, the guide pins 38 are respectively engaged with the guide parts 29 in a manner capable of sliding in the longitudinal direction of the guide pin 38 (i.e. in the longitudinal direction Y). Also, each guide pin 38 is rotatable in the circumferential direction thereof in a state in which the guide pin 38 is engaged with the guide part 29. The photosensitive unit 30 is slidable relative to the developing unit 20 in the longitudinal direction Y in a state in which the guide pins 38 are engaged with the guide parts 29, and also is pivotable in the direction in which the photosensitive drum 31 and the developing roller 21 separate from each other about the guide pins 38 each as a fulcrum.

Figure 8:
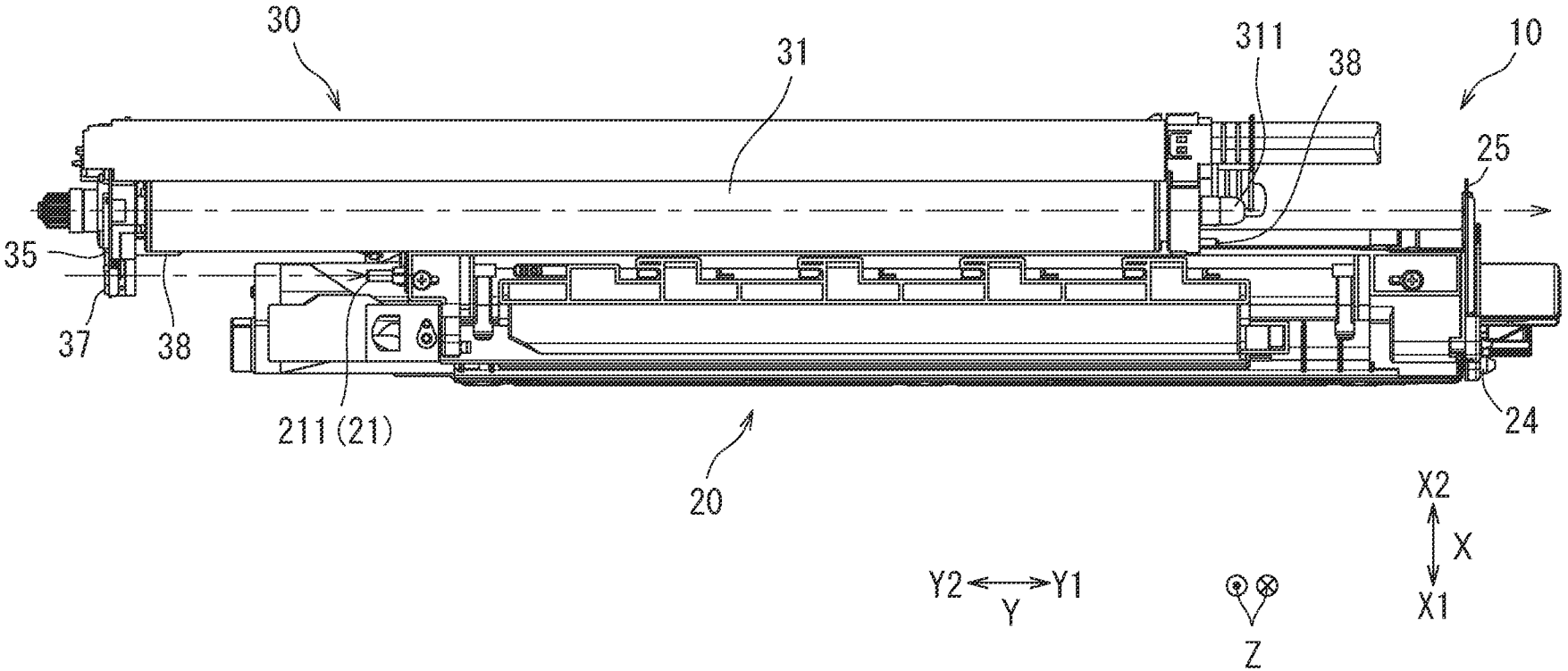
FIG. 8 is a plan view illustrating a state in which the developing unit and the photosensitive unit are integrated with each other.

FIG. 8 is a plan view illustrating a state in which the developing unit 20 and the photosensitive unit 30 are integrated with each other. When integrating the developing unit 20 and the photosensitive unit 30, the developing unit 20 and the photosensitive unit 30 are moved closer to each other so that the guide pins 38 provided on the front and rear sides of the photosensitive unit 30 are engaged with the developing unit 20. The guide pin 38 on the front side Y1 is fitted in the guide recess 291 and moved forward such that the guide pin 38 is being inserted, from the tip part thereof, into the guide part 29. Then, the photosensitive unit 30 is slid with respect to the developing unit 20 in a state in which the guide pins 38 on the front and rear sides are respectively engaged with the developing unit 20. In this way, it is possible to fit the front end part of the drum shaft 311 in the developing unit 20 and to fit the rear end part of the roller shaft 211 in the photosensitive unit 30 while preventing positional displacement between the photosensitive unit 30 and the developing unit 20.

Here, the first holding member 26 and the second holding member 37 as the engaging mechanism parts are both slidable in the direction in which the developing roller 21 and the photosensitive drum 31 separate from each other. As shown in FIG. 2, the first holding member 26 provided on the first supporting part 25 of the developing unit 20 includes: a first fitting hole 261; a plurality of claw parts 262; and a locking part 263 of a biasing member 27. In the first fitting hole 261, the drum shaft 311 (see FIG. 5) is fitted. The drum shaft 311 protrudes in the front side Y1 direction of the photosensitive unit 30. The first fitting hole 261 is a cylindrical hole having a size corresponding to the tip part of the drum shaft 311 of the photosensitive drum 31.

The claw parts 262 are provided on the opposite side edges of the first holding member 26 one by one. A sliding hole 251 is provided so as to penetrate the front and back surfaces of the first supporting part 25 of the developing unit 20. The first holding member 26 is fitted in the sliding hole 251. The claw of the claw part 262 is formed not only on the front side Y1 shown in FIG. 2, but also on the opposite side (back side Y2) so as to have the same shape as that of the front side with the sliding hole 251 being interposed therebetween, as shown in FIG. 3. In this configuration, the claw parts 262 respectively formed on the two side edges each sandwich the opening edge of the sliding hole 251 by the front and back claws, and thus are locked to the opening edge of the sliding hole 251. The first holding member 26 is slidably held by the sliding hole 251.

Figure 9:
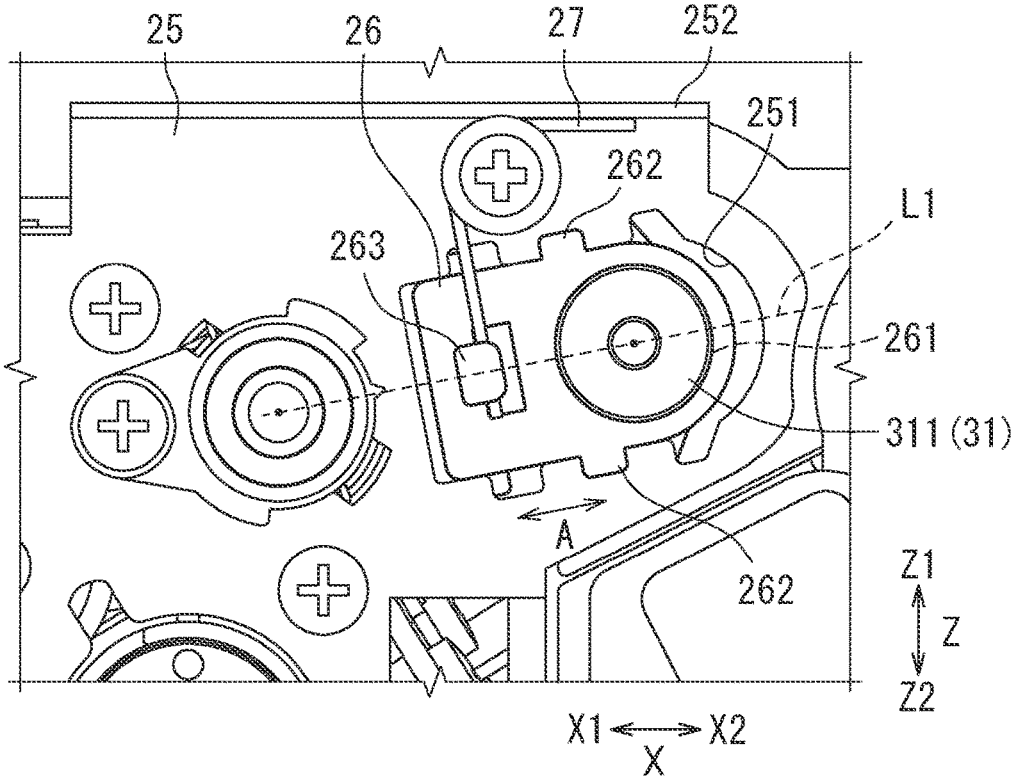
FIG. 9 is an explanatory view enlarging and illustrating a first supporting part and a first holding member of the developing unit to indicate a drum shaft in the middle of being fitted in a fitting hole.
Figure 10:
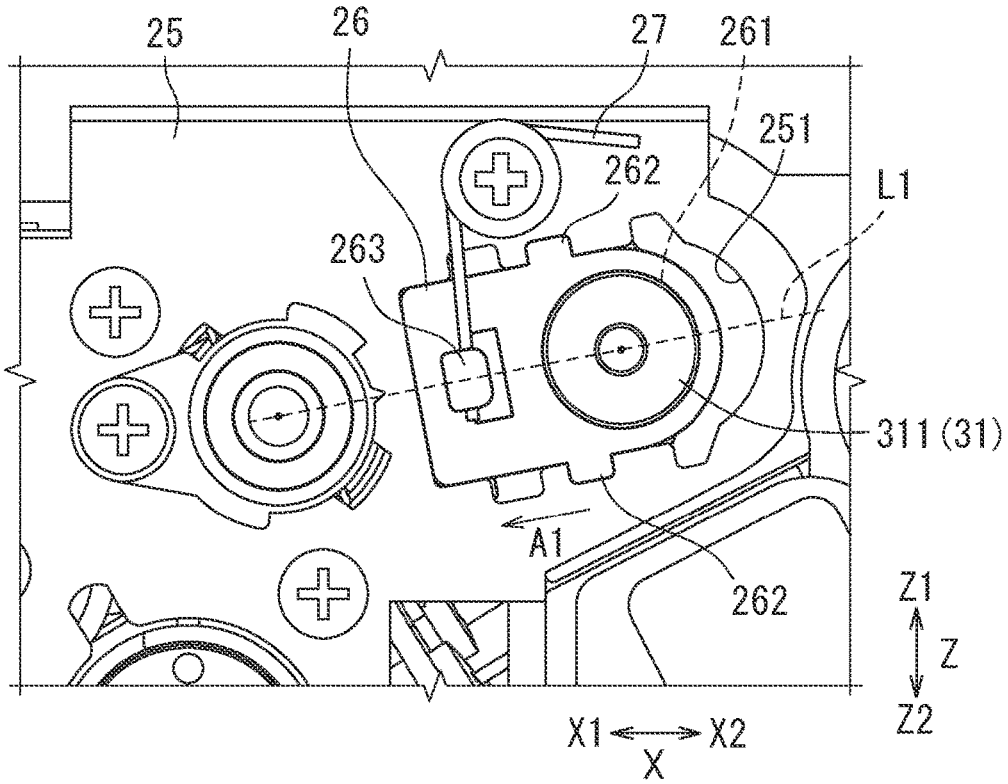
FIG. 10 is an explanatory view enlarging and illustrating the first supporting part and the first holding member of the developing unit to indicate the drum shaft that is fitted in the fitting hole.

FIGS. 9 and 10 are explanatory views enlarging and illustrating the first supporting part 25 and the first holding member 26 of the developing unit 20. FIG. 9 indicates the drum shaft 311 in the middle of being fitted in the fitting hole, and FIG. 10 indicates the drum shaft 311 that is fitted in the fitting hole.

As shown in FIG. 9, the sliding hole 251 is elongated along a virtual straight line L1 so as to have a length longer than the length of the first holding member 26. The first holding member 26 is formed so as to have a vertically symmetrical shape with respect to the virtual straight line L1. The claw parts 262 are provided on the upper and lower side edges of the first holding member 26.

The virtual straight line L1 is a straight line connecting the rotation center of the developing roller 21 and the rotation center of the photosensitive drum 31. The sliding hole 251 and the first holding member 26 are disposed along the virtual straight line L1. The first holding member 26 is supported by the claw parts 262 locked to the sliding hole 251, and thus is slidable in the A direction in FIG. 9 along the virtual straight line L1. Thus, the first holding member 26 is slidable in the direction in which the developing roller 21 and the photosensitive drum 31 separate from each other.

Also, the first holding member 26 is provided with the biasing member 27 by which it is biased toward the A1 direction on the virtual straight line L1. In this example, a torsion spring is used as the biasing member 27, and a toroidal coil part of the torsion spring is attached to the first supporting part 25. As shown in FIG. 9, one end part of the torsion spring is locked to the locking part 263 provided in a protruding manner on the front surface of the first holding member 26, on the left side X1. The other end part of the torsion spring comes into contact with a locking part 252 provided in a protruding manner on the upper side of the first supporting part 25.

In the state shown in FIG. 9, the torsion spring is contracted, and the one end part thereof presses the locking part 263 so that the biasing force toward the A1 direction acts on the first holding member 26. The first holding member 26 is biased toward the direction in which the developing roller 21 and the photosensitive drum 31 come close to each other (i.e. the A1 direction) along the virtual straight line L1, and returns in the A1 direction after sliding, as shown in FIG. 10.

As shown in FIG. 6, the second holding member 37 provided on the second supporting part 36 of the photosensitive unit 30 includes: a second fitting hole 371; a plurality of claw parts 373; and a locking part 374 of a biasing member 39. In the second fitting hole 371, the roller shaft 211 (see FIG. 3) is fitted. The roller shaft 211 protrudes in the back side Y2 direction of the developing unit 20. The second fitting hole 371 is a cylindrical hole having a size corresponding to the tip part of the roller shaft 211 of the developing roller 21.

The claw parts 373 are provided on both ends of the second holding member 37 in the long side direction. In FIG. 6, one claw part 373 is illustrated, which is provided in a protruding manner on the end in the left side X1. The other claw part 373 is provided in a protruding manner on the back surface (i.e, the surface on the front side Y1).

Figure 11:
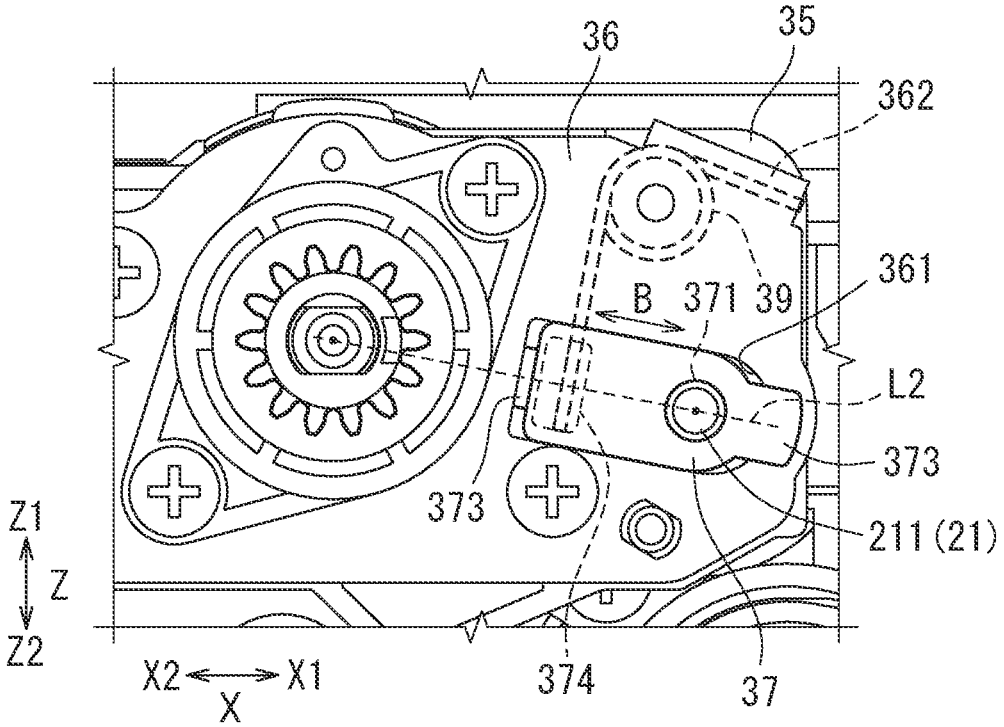
FIG. 11 is an explanatory view enlarging and illustrating a second supporting part and a second holding member of the photosensitive unit to indicate a roller shaft in the middle of being fitted in a fitting hole.
Figure 12:
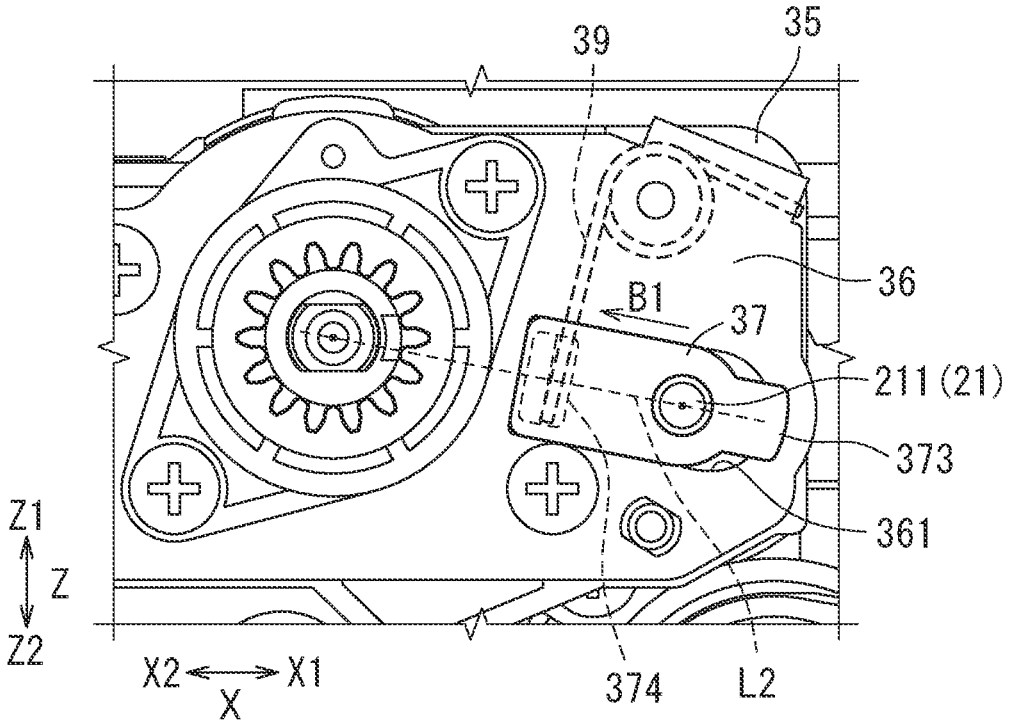
FIG. 12 is an explanatory view enlarging and illustrating the second supporting part and the second holding member of the photosensitive unit to indicate the roller shaft that is fitted in the fitting hole.

FIGS. 11 and 12 are explanatory views enlarging and illustrating the second supporting part 36 and the second holding member 37 of the photosensitive unit 30. FIG. 11 indicates the roller shaft 211 in the middle of being fitted in the fitting hole, and FIG. 12 indicates the roller shaft 211 that is fitted in the fitting hole.

A sliding hole 361 is provided so as to penetrate the front and back surfaces of the second supporting part 36 of the photosensitive unit 30. The second holding member 37 is fitted in the sliding hole 361. The claw of one claw part 373 shown in FIG. 11 is formed not only on the front side Y1, but also on the opposite side (back side Y2) so as to have the same shape as that of the front side with the sliding hole 361 being interposed therebetween. Thus, the one claw part 373 sandwiches the opening edge of the sliding hole 361, and is locked to the opening edge of the sliding hole 361. The other claw part 373 is formed on the end of the back surface of the second holding member 37, on the right side X2, and is locked to the opening edge of the sliding hole 361. Thus, the second holding member 37 is slidably held by the sliding hole 361.

The sliding hole 361 is elongated along a virtual straight line L2. The second holding member 37 is formed so as to have a vertically symmetrical shape with respect to the virtual straight line L2. The claw parts 373 are provided respectively on the left and right side edges of the second holding member 37. The virtual straight line L2 is a straight line connecting the rotation center of the developing roller 21 and the rotation center of the photosensitive drum 31. The sliding hole 361 and the second holding member 37 are disposed along the virtual straight line L2. The second holding member 37 is supported by the claw parts 373 locked to the sliding hole 361, and thus is slidable in the B direction in FIG. 10 along the virtual straight line L2. Thus, the second holding member 37 is slidable in the direction in which the developing roller 21 and the photosensitive drum 31 separate from each other.

The second holding member 37 is also provided with the biasing member 39 by which it is biased toward the B1 direction on the virtual straight line L2. For example, a torsion spring is used as the biasing member 39, and a toroidal coil part of the torsion spring is attached to the surface on the front side Y1 (in FIG. 11, to the back surface) of the second supporting part 36. On the back surface of the second supporting part 36, one end part of the torsion spring is locked to the locking part 374 provided in a protruding manner on the second holding member 37, on the right side X2, while the other end part of the torsion spring is locked to a locking part 362 provided in a protruding manner on the upper side of the second supporting part 36.

In the state shown in FIG. 11, the torsion spring is contracted, and the one end part thereof presses the locking part 374 so that the biasing force toward the B1 direction acts on the second holding member 37. That is, the second holding member 37 is biased toward the direction in which the developing roller 21 and the photosensitive drum 31 come close to each other (i.e. the B1 direction) along the virtual straight line L2. The second holding member 37 is slidable in the sliding hole 361 in the B direction, and after sliding against the biasing force, the second holding member 37 returns in the B1 direction.

Figure 13A:
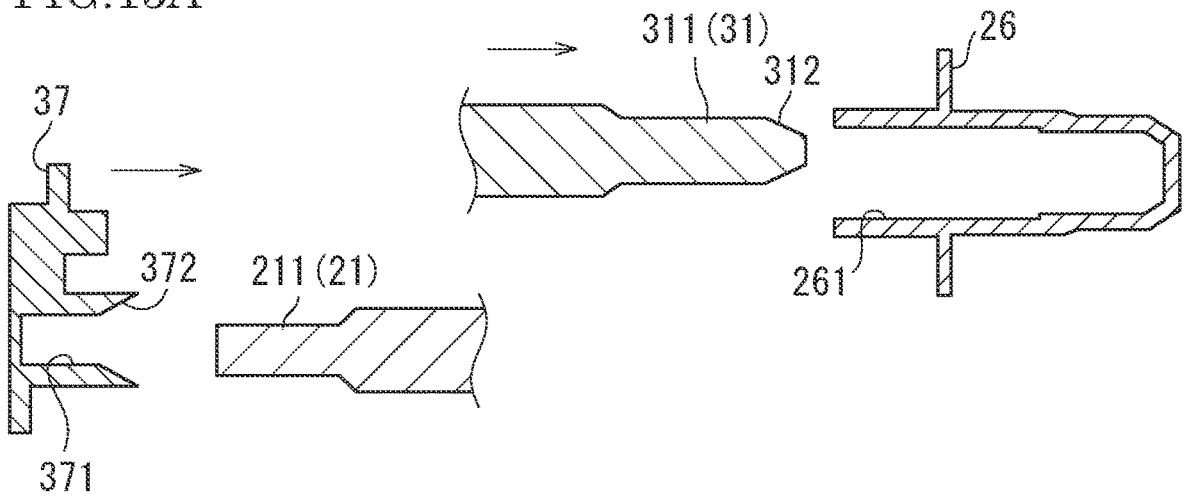
FIG. 13A is an explanatory cross-sectional view schematically illustrating the roller shaft and the drum shaft when the photosensitive unit is slid with respect to the developing unit.
Figure 13B:
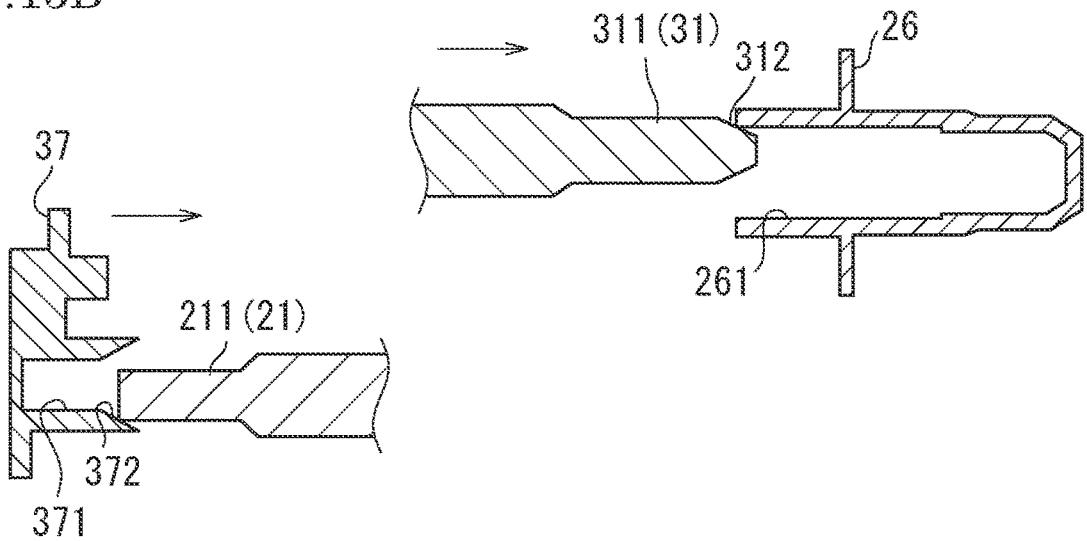
FIG. 13B is an explanatory cross-sectional view schematically illustrating the roller shaft and the drum shaft respectively in the middle of being fitted in the fitting holes.
Figure 13C:
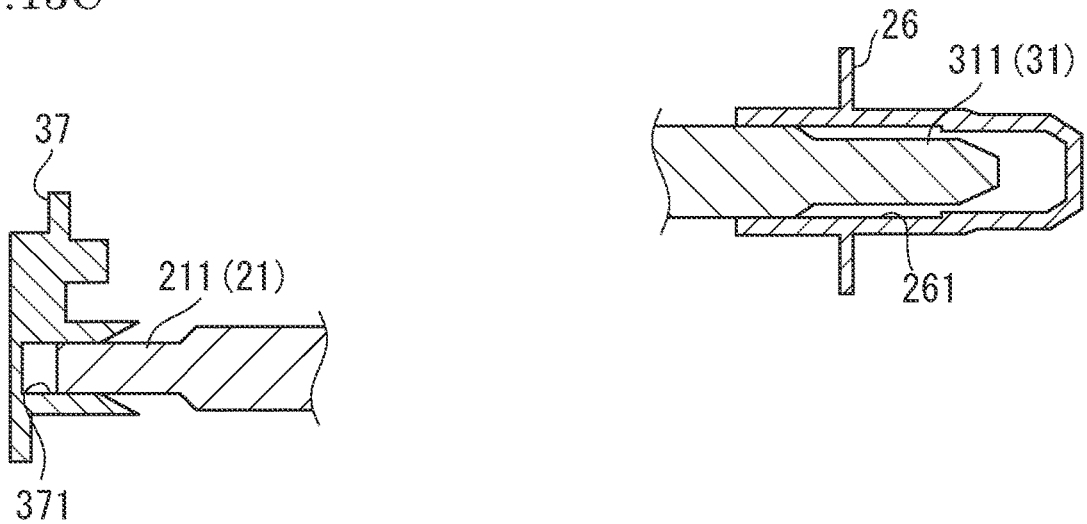
FIG. 13C is an explanatory cross-sectional view schematically illustrating the roller shaft and the drum shaft that are respectively fitted in the fitting holes.
Figure 14:
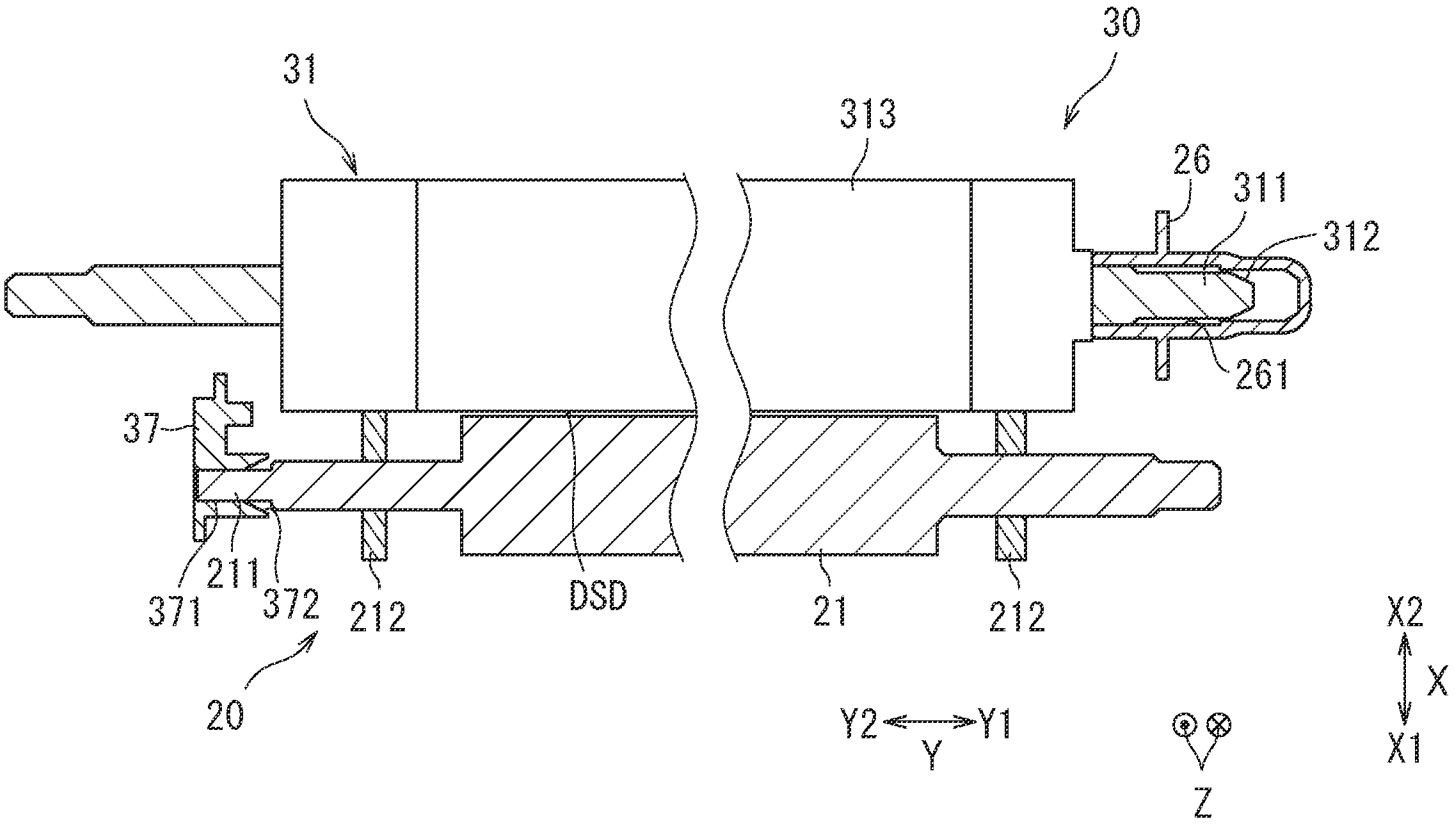
FIG. 14 is an explanatory plan view schematically illustrating the developing roller and the photosensitive drum in a state in which the developing unit and the photosensitive unit are integrated with each other.

FIGS. 13A to 13C are explanatory cross-sectional views schematically illustrating the roller shaft 211 and the drum shaft 311 when the photosensitive unit 30 is slid with respect to the developing unit 20. FIG. 14 is an explanatory plan view schematically illustrating the developing roller 21 and the photosensitive drum 31 in a state in which the developing unit 20 and the photosensitive unit 30 are integrated with each other.

It is preferable that at least either one of the drum shaft 311 fitted in the first holding member 26 and the roller shaft 211 fitted in the second holding member 37 has a tapered part at the tip pare thereof. In this embodiment, a tapered part 312 is provided at the tip part of the drum shaft 311. Also, it is preferable that at least either one of the first fitting hole 261 in which the drum shaft 311 is fitted and the second fitting hole 371 in which the roller shaft 211 is fitted has a tapered part on the inner surface thereof. In this embodiment, a tapered part 372 is provided on the inner surface of the second fitting hole 371. With this configuration, the drum shaft 311 and the roller shaft 211 are easily fitted in the respective fitting holes when the photosensitive unit 30 is slid with respect to the developing unit 20.

Also, a spacing member 212 is provided on the roller shaft 211, which rotates in a state of coming into contact with the outside of an image forming region 313 of the photosensitive drum 31. As shown in FIG. 14, when the developing unit 20 and the photosensitive unit 30 are integrated with each other, the spacing member 212 maintains a certain distance from the roller shaft 211 of the developing roller 21 to the photosensitive drum 31. The distance between the respective outer peripheral surfaces of the photosensitive drum 31 and the developing roller 21 (i.e. the DSD) is set, for example, as 0.3 to 0.5 mm.

When the photosensitive unit 30 is slid with respect to the developing unit 20, the photosensitive drum 31 comes close to the developing roller 21 in a state in which the guide pins 38 and the guide parts 29 are engaged with each other as described above so as to serve as the rotating fulcrums until the spacing member 212 comes into contact with the photosensitive drum 31. Since the drum shaft 311 of the photosensitive drum 31 and the roller shaft 211 of the developing roller 21 are respectively biased toward the direction in which the developing roller 21 and the photosensitive drum. 31 come close to each other, the spacing member 212 is positioned at a location where it comes into contact with the outside of the image forming region 313 of the photosensitive drum 31 so as to form a predetermined DSD.

More specifically, as shown in FIG. 13A, when the photosensitive unit 30 is slid with respect to the developing unit 20, the drum shaft 311 is moved to the first holding member 26 of the developing unit 20 so as to be fitted in the first fitting hole 261. As shown in FIG. 13B, since the tapered part 312 is provided at the tip part of the drum shaft 311, the positional displacement between the drum shaft 311 and the first fitting hole 261 is allowed, which leads to smooth fitting of the drum shaft 311 in the first fitting hole 261.

At the same time, the second holding member 37 of the photosensitive unit 30 is moved to the roller shaft 211 of the developing roller 21 so as to fit the roller shaft 211 therein, as shown in FIG. 13A. As shown in FIG. 13B, since the tapered part 372 is provided in the second fitting hole 371 of the second holding member 37, the positional displacement of the second fitting hole 371 from the roller shaft 211 is allowed, which leads to smooth fitting of the roller shaft 211 in the second fitting hole 371.

When the photosensitive unit 30 is further slid with respect to the developing unit 20, the drum shaft 311 of the photosensitive drum 31 is fitted in the first fitting hole 261 of the first holding member 26 while the roller shaft 211 of the developing roller 21 is fitted in the second fitting hole 371 of the second holding member 37, as shown in FIG. 13C. Thus, the photosensitive unit 30 and the developing unit 20 are positioned and integrated with each other. In this case, the DSD between the photosensitive drum 31 and the developing roller 21 is appropriately set by the front and rear spacing members 212.

As shown in FIG. 13B, when the drum shaft 311 is fitted in the first fitting hole 261, the first holding member 26 comes close to the position of the drum shaft 311 and functions to fit the drum shaft 311 in the first fitting hole 261. Specifically, as shown in FIGS. 9 and 10, the first holding member 26 is biased toward the A1 direction (i.e. the direction in which the developing roller 21 and the photosensitive drum 31 come close to each other), and then, when the drum shaft 311 is fitted in the first fitting hole 261, the first holding member 26 resists the biasing force and is slid in the opposite direction of the A1 direction so that the drum shaft 311 can enter the first holding member 26. Thus, the drum shaft 311 is fitted in the first holding member 26 with the help of the function of the tapered part 312 while the first holding member 26 is moved in the direction in which the developing roller 21 and the photosensitive drum 31 separate from each other.

Also, when the second holding member 37 is fitted in the roller shaft 211, the second holding member 37 comes close to the position of the roller shaft 211 and functions such that the roller shaft 211 is fitted in the second fitting hole 371. Specifically, as shown in FIGS. 11 and 12, the second holding member 37 is biased toward the B1 direction (i.e. the direction in which the developing roller 21 and the photosensitive drum 31 come close to each other), and then, when the roller shaft 211 is fitted in the second holding member 37, the second holding member 37 resists the biasing force and is slid in the opposite direction of the B1 direction, so that the roller shaft 211 can enter the second holding member 37 with the help of the function of the tapered part 372. Thus, the roller shaft 211 is fitted in the second holding member 37 while the second holding member 37 is moved in the direction in which the developing roller 21 and the photosensitive drum 31 separate from each other.

After the drum shaft 311 is fitted in the first fitting hole 261 and also the roller shaft 211 is fitted in the second fitting hole 371, the first holding member 26 is slid in the A1 direction and the second holding member 37 is slid in the B1 direction, both by the biasing force. Then, when the spacing members 212 come into contact with the outside of the image forming region 313 of the photosensitive drum 31, the sliding movement is stopped. Thus, the developing roller 21 is arranged such that the developing roller 21 is parallel to the photosensitive drum. 31 and that the respective outer peripheral surfaces of the developing roller 21 and the photosensitive drum 31 come close to each other (see FIG. 14). In this way, the appropriate DSD between the developing roller 21 and the photosensitive drum 31 is maintained, and in this state, the developing unit 20 and the photosensitive unit 30 are positioned and integrated with each other. The thus integrated developing unit 20 and the photosensitive unit 30 can be installed in a predetermined position of the apparatus main body 11.

As described above, integration as the process cartridge 10 can be performed by a simple operation that the photosensitive unit 30 is slid with respect to the developing unit 20. Furthermore, the DSD is appropriately defined by the spacing members 212 on the front side 11 and the back side 12 in such an integrated state. Thus, the DSD is stably maintained with high accuracy.

Furthermore, the first holding member 26 and the second holding member 37, which support respectively the drum shaft 311 of the photosensitive drum 31 and the roller shaft 211 of the developing roller 21, are slidable in the direction in which the developing roller 21 and the photosensitive drum 31 separate from each other while they are biased toward the direction in which the developing roller 21 and the photosensitive drum 31 come close to each other. Thus, the DSD can be set with high accuracy and stably maintained without depending on product accuracy and/or assembling accuracy.

The first holding member 26 and the second holding member 37 are slid in the direction in which the developing roller 21 and the photosensitive drum 31 separate from each other in order to fit the drum shaft 311 and the roller shaft 211 respectively therein. Thus, the positioning can be performed in a state in which the developing unit 20 does not come into contact with the image forming region 313 of the photosensitive drum 31. Also, the process cartridge 10 can be easily divided into the photosensitive unit 30 and the developing unit 20 by an operation reverse to assembling as described above. Therefore, it is possible to remarkably reduce workload when assembling or disassembling the process cartridge 10, which also leads to improvement of maintainability.

In the above-described embodiment, the photosensitive unit 30 can be pivoted with respect to the developing unit 20 about the guide pins 38 each as the rotating fulcrum. However, this rotational movement is not necessarily required. However, by engaging the guide pins 38 with the guide parts 29 in advance, operability at the time of assembling can be improved. As to the first holding member 26 included in the developing unit 20 and the second holding member 37 included in the photosensitive unit 30, their respective positional arrangements or shapes are not limited to those in the above embodiment.

The present invention may be embodied in other forms without departing from the gist or essential characteristics thereof. The foregoing embodiment is therefore to be considered in all respects as illustrative and not limiting. The scope of the invention is indicated by the appended claims rather than by the foregoing description, and all modifications and changes that come within the meaning and range of equivalency of the claims are intended to be embraced therein.

What is claimed is:

1. An image forming apparatus comprising: a developing unit including a developing roller; and a photosensitive unit including a photosensitive drum, the developing unit and the photosensitive unit being separably integrated with each other so as to be installed in and removed from an apparatus main body in an integrated state, wherein the developing unit and the photosensitive unit are disposed in a state capable of relative movement in an axial direction of a drum shaft of the photosensitive drum, the developing unit and the photosensitive unit each has an engaging mechanism part to fit in each other in the axial direction according to the relative movement so as to integrate the developing unit and the photosensitive unit, the developing unit includes, as the engaging mechanism part: a first supporting part extending toward the photosensitive unit; and a first holding member provided on the first supporting part so as to hold one end part of the drum shaft, the photosensitive unit includes, as the engaging mechanism part: a second supporting part extending toward the developing unit; and a second holding member provided on the second supporting part so as to hold one end part of a roller shaft, which is on a side opposite to the one end part of the drum shaft, of the developing roller, the first holding member and the second holding member are provided both in a slidable manner in a direction in which the developing roller and the photosensitive drum separate from each other, and the first holding member and the second holding member each has a biasing member so that the first holding member and the second holding member are respectively biased toward a direction in which the developing roller and the photosensitive drum come close to each other.

2. The image forming apparatus according to claim 1, wherein the first holding member and the second holding member are disposed on a virtual straight line connecting a rotation center of the developing roller and a rotation center of the photosensitive drum so that the first holding member and the second holding member are slidable on the virtual straight line.

3. The image forming apparatus according to claim 1, wherein at least either one of the drum shaft and the roller shaft has a tapered part at a tip part thereof.

4. The image forming apparatus according to claim 1, wherein the first holding member includes a first fitting hole in which the drum shaft is fitted, the second holding member includes a second fitting hole in which the roller shaft is fitted, and at least either one of the first fitting hole and the second fitting hole has a tapered part on an inner surface thereof.

5. The image forming apparatus according to claim 1, wherein the roller shaft has a spacing member that rotates in a state of coming into contact with an outside of an image forming region of the photosensitive drum.

6. The image forming apparatus according to claim 1, wherein the biasing member is a torsion spring.

* * * * *